United States Patent [19]

Guilpain et al.

[11] 4,371,970

[45] Feb. 1, 1983

[54] DOME FOR ELECTRIC ARC FURNACE

[75] Inventors: Bernard Guilpain, Saint Etienne; Xavier Tinchant, Villars, both of France

[73] Assignee: Clesid S.A., Saint-Chamond, France

[21] Appl. No.: 168,468

[22] Filed: Jul. 10, 1980

[30] Foreign Application Priority Data

Feb. 22, 1980 [FR] France ..... 80 03924

[51] Int. Cl.[3] ..... F27D 1/12

[52] U.S. Cl. ..... 373/74

[58] Field of Search ..... 13/32, 35; 373/73, 74

[56] References Cited

U.S. PATENT DOCUMENTS

| | | | |
|---|---|---|---|
| 3,533,611 | 10/1970 | Boyer et al. | 13/9 R |
| 3,604,376 | 9/1971 | Meyer | 13/9 X |
| 3,967,048 | 6/1976 | Longenecker | 13/32 X |
| 4,021,603 | 5/1977 | Nanjyo | 13/35 |
| 4,216,348 | 8/1980 | Greenberger | 13/32 |

FOREIGN PATENT DOCUMENTS

| | | | |
|---|---|---|---|
| 1433447 | 7/1964 | Fed. Rep. of Germany | 13/32 |

*Primary Examiner*—Roy N. Envall, Jr.

*Attorney, Agent, or Firm*—Pollock, Vande Sande & Priddy

[57] ABSTRACT

A dome for an electric arc furnace comprising a central portion of refractory material and a cooled metallic crown consisting of two toroidal conduits joined by radial tubes in such a manner that it is curved. Its own volume permits variations in gas emissions during steel production to be absorbed. It comprises a manifold which fits into an extraction pipeline, so that most of the gas may be collected so as to avoid pollution. A fluid circulates in the conduits and the tubes to cool the crown.

7 Claims, 6 Drawing Figures

DOME FOR ELECTRIC ARC FURNACE

FIELD OF THE INVENTION

The present invention relates to improvements made to the domes of electric arc furnaces and it relates more particularly, but not exclusively, to such a dome constructed in a composite manner, comprising a central portion made of refractory material and a metallic crown cooled by water circulation.

BACKGROUND

It is known that at present there is an ever increasing tendency to construct the domes of electric arc furnaces in a composite manner, as indicated above, because this new arrangement is more economical. It will easily be understood that it is not possible to construct an electric furnace dome entirely of metal because of the particularly intense variations in field at the level of the passage of the electrodes. The large amount of energy which is dissipated at this level in the form of heat leads to the necessity of making this portion of the cover of a refractory material. On the other hand, the peripheral portion of the dome where the variations in field are much less can be metallic, on condition that it comprises a cooling circuit.

Domes thus constructed are known, but they have serious disadvantages principally because they are made plane, so that every time there are sudden variations in the volume of gas emitted during the production of the steel, fumes laden with dust and gas, such as carbon monoxide, are released outside the furnace.

SUMMARY OF THE INVENTION

The improvements which form the subject of the present invention aim at overcoming this disadvantage and therefore at avoiding the pollution of the atmosphere of the steelworks.

For this purpose, the dome according to the invention comprises means for collecting the gases originating from the production of the steel and for absorbing the sudden variations in volume of these gases in the course of the operation in question.

According to a preferred embodiment, the dome according to the invention is of general curved or conical shape with concavity or conicity facing towards the hearth. It further comprises a gas collector connected to an extraction pipeline. This pipeline may advantageously have dimensions slightly larger than those of the collector, so as to constitute a sort of air pump, as a result of which the combustive air mixes with the gas collected. Thus the combustion of the latter is facilitated, for example, the oxidation of the carbon monoxide.

According to a first embodiment, the crown of the dome according to the invention is constructed by means of two concentric toroidal pipes connected by radial tubes, means being provided to assure the circulation of a cooling fluid in this crown. Some of the radial tubes are adapted in such a manner as to form a passage which fits into the extraction pipeline.

According to another embodiment of the crown of the dome according to the invention, another pipe, similar to the one situated inside the crown and disposed above this is provided, these two pipes being connected by means on the one hand of a double partition or "water jacket", and on the other hand by a nest of tubes, in such a manner as to form an annular chamber for the collection of gas, comprising a sleeve fitting into the extraction pipeline. The walls of this sleeve are constructed by means of tubes placed side by side which connect two collectors in such a manner that a circulation of cooling fluid can develop in this sleeve.

BRIEF DESCRIPTION OF THE DRAWINGS

The invention will now be described in more detail with reference to a particular embodiment given by way of example and illustrated in the accompanying drawings, in which.

DESCRIPTION OF AN EMBODIMENT

Figure 1:
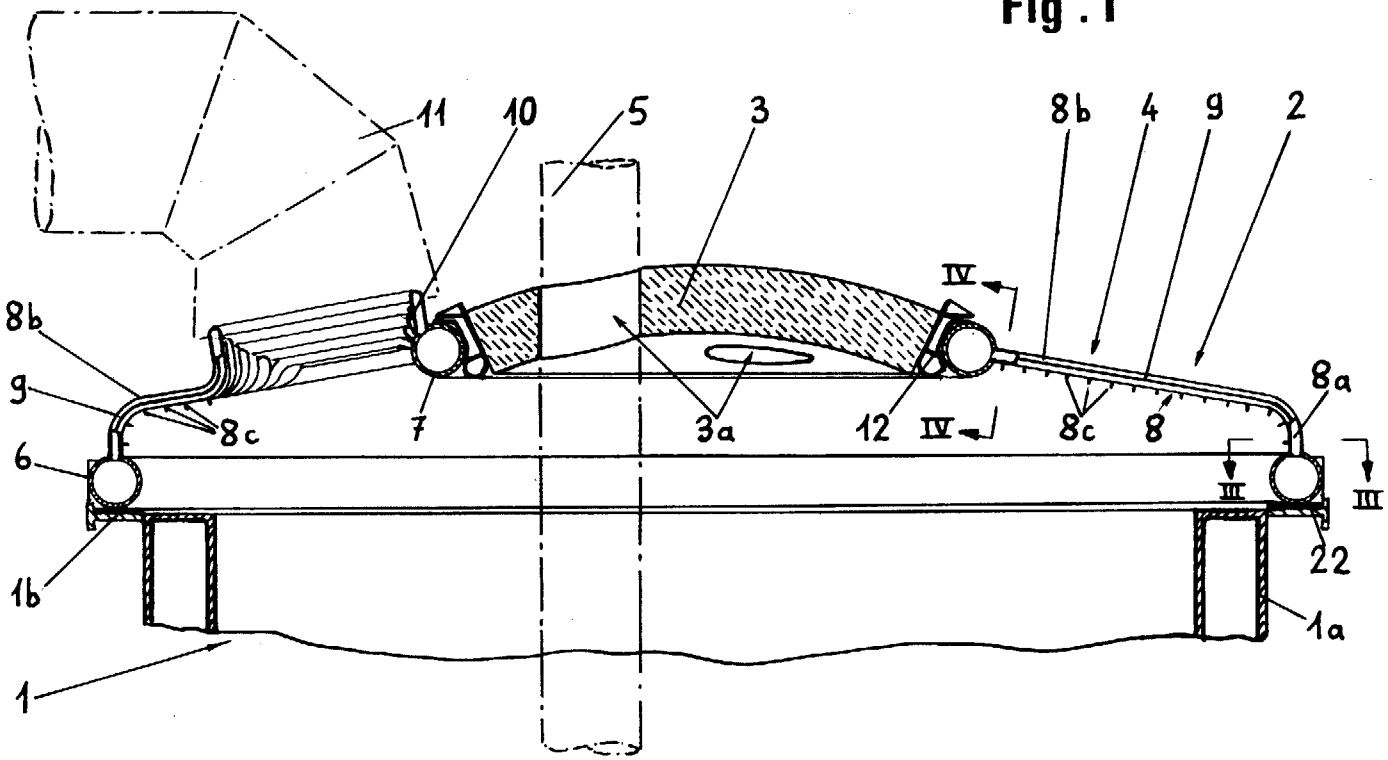
FIG. 1 is a partial cross section of an electric furnace comprising a dome constructed according to the invention.

FIG. 1 illustrates the upper portion of the vessel 1 of an electric arc furnace, the opening of which is closed by a cover 2 constructed according to the present invention. The lateral wall 1*a* is double, so that it can be cooled by circulation of an appropriate fluid. The upper portion of the wall 1*a* is provided with a horizontal peripheral flange 1*b* adapted to support the cover 2.

This cover comprises a central portion 3 constructed of refractory material and a crown 4 which surrounds this central portion. This is provided with three perforations 3*a* adapted for the passage of the electrodes 5 of the arc furnace, and of which only one is illustrated (in broken lines).

Figure 2:
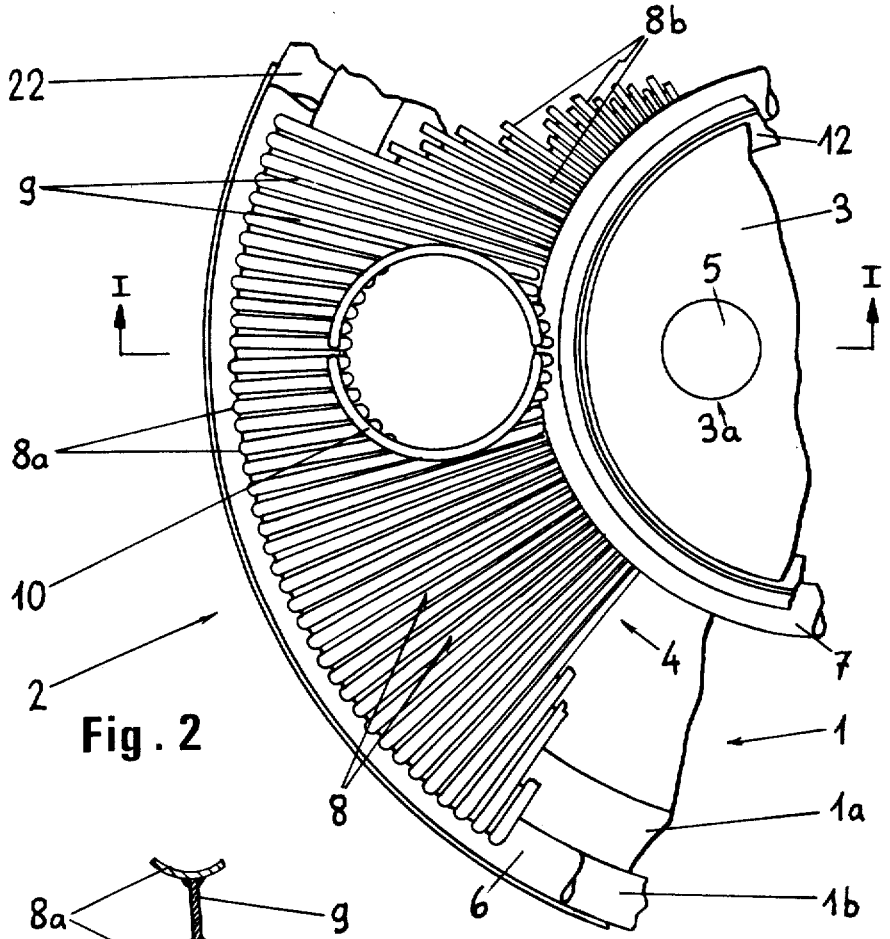
FIG.2 is a partial view from above in which the section plane of FIG. 1 is represented at I—I.
Figure 3:
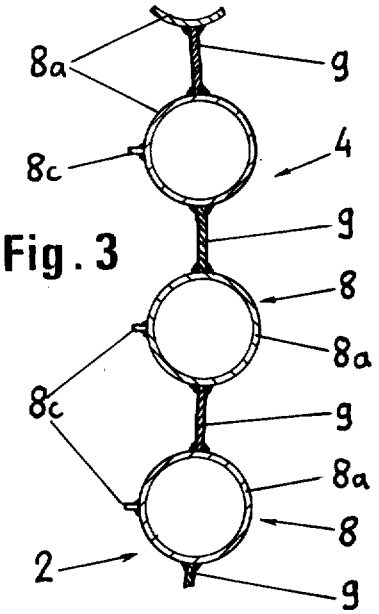
FIG. 3 is an enlarged section view on line III—III of FIG. 1.
Figure 4:
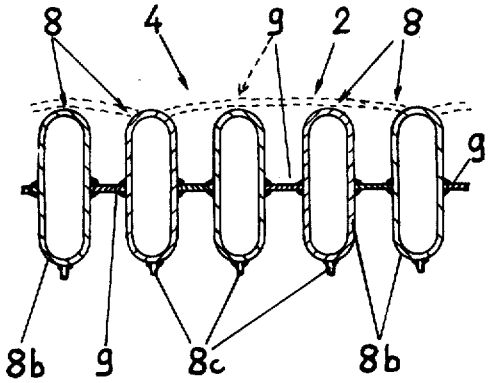
FIG. 4 illustrates, on the same scale, a section on line IV—IV of FIG. 1.

The crown of the cover 2 is constructed by means of two pipes 6,7 disposed concentrically to one another, but the second being in a plane situated at a higher level than that containing the first, so that the general shape of the cover 2 is curved, with concavity turned towards the vessel 1. The space situated between the two aforesaid pipes is closed by a multiplicity of radial tubes 8 connecting the two pipes in such a manner as to constitute a vast coil for the circulation of a cooling fluid. Each tube 8 is of circular section at the beginning as shown in FIG. 3. Each tube has a shape in the form of an angle member with an obtuse angle, that is to say it is provided with a short vertical branch 8*a* of circular section, and with another oblique one 8*b* of much greater length. The portion 8*a* of the tubes is welded to the top of the pipe 6. The branch 8*b* of each tube is progressively constricted so that at the level of the pipe 7 it has a width much less than the diameter of the branch 8*a*, as illustrated in FIGS. 2 and 4. In other words, in profile, in plan, each tube diminishes in width as the center of the cover is approached. Placed between each tube ia a member 9 in such a manner as to constitute a continuous surface. Naturally, the members, made of sheet steel, have a shape adapted to permit their cooperation with the two opposite lateral faces of two adjacent tubes. In a modification, so as to give greater flexibility to the dome while retaining its tightness, members 9 connecting non-adjacent tubes, for example placed at every third one, could be used, as illustrated in dotted lines in FIG. 4.

With a view to constituting a collector or exhaust manifold 10 for the gases released by the production of steel in the furnace, the branches 8b of a certain number of tubes 8 are deformed in such a manner as to make said manifold. As shown in FIGS. 1 and 2, the upper branch 8b of the tubes in question is first bent upwards, then it adopts the shape of a portion of a circle before being connected to the pipe 7. The external diameter of the manifold 10 is slightly less than that of an extraction pipeline 11 adapted to take the gases towards a combustion device for the reasons given above.

It will be observed that the internal face of the pipe 7 is associated with a section member 12 adapted to constitute the support of the refractory central portion 3 of the dome. The face of this support is conical, with an opening upwards in such a manner that the periphery of the cover 3 with a corresponding profile simply comes to bear on it.

Figure 5:
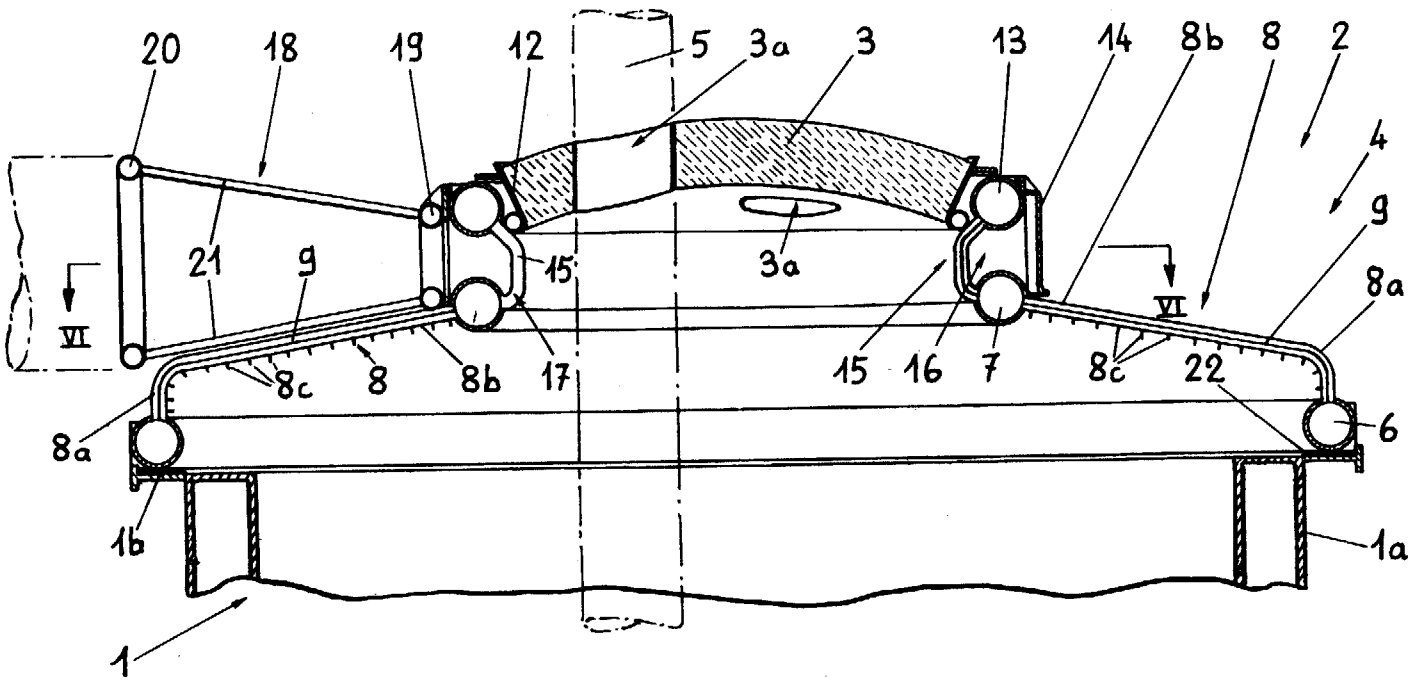
FIG. 5 is a view similar to FIG. 1, but illustrating a modification.
Figure 6:
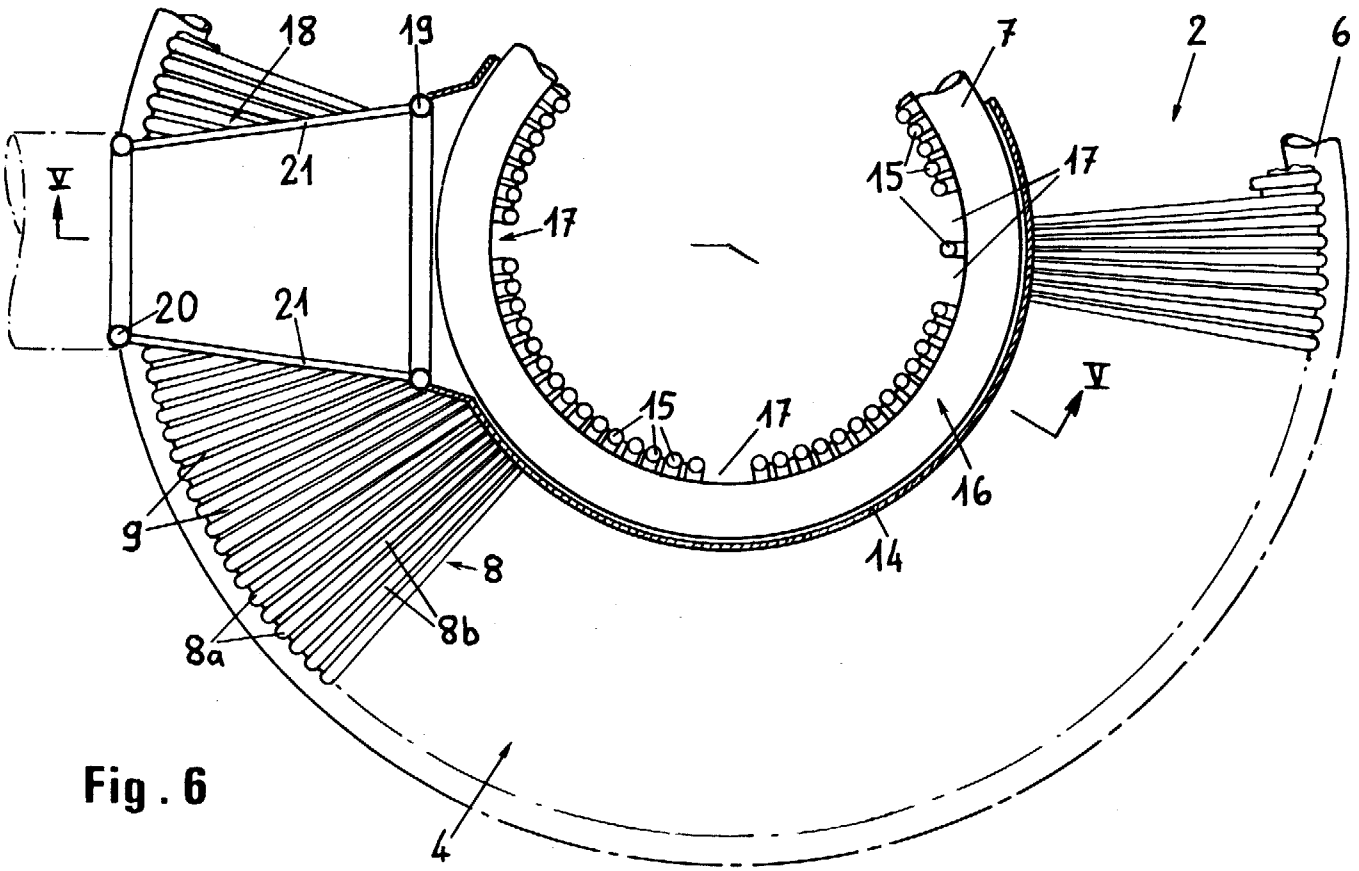
FIG. 6 is a section on line VI—VI of FIG. 5. The section plane of FIG. 3 is represented there at V—V.

According to the modification illustrated in FIGS. 5 and 6, provision is made to collect the gases released at the time when the steel is produced, in a central manner round the portion 3 of the dome. For this purpose a tubular ring 13 of the same dimensions is disposed above the pipeline 7. This ring is connected to the pipeline 7 on the one hand by a double external partition 14, called a "water jacket", and on the other hand by a nest of bent tubes 15, situated inside the double partition 14. Thus an annular chamber 15 for collecting the gases is formed. The nest of tubes 15 constitutes a continuous wall which is nevertheless interrupted by passages 17 to enable it to brought into communication with the interior of the dome, i.e., with the vessel 1. The gases which are formed at the time of production of the steel therefore accumulate in the top of the cover and enter the chamber 16 as a result of the fact that this is subjected to reduced pressure by means of a sleeve 8 communicating with the extraction pipeline 11. The sleeve 18 is constructed by means of two tubular collectors 19,20, joined by tubes 21.

As in the example illustrated in FIG. 1, the tubular ring 13 is assocatied with the support 12 of the central portion 3 of the dome.

As a result of the construction of the domes according to the two variants described above, it is easily possible to cause a cooling flud to circulate between the two crowns 4. In the modification of FIGS. 5 and 6, said circulation enters the tubular ring 13 through the double partition 14 to return through the nest of tubes 15 or vice versa. Moreover, the circulation of cooling fluid is likewise transmitted into the hollow elements of the sleeve with a view to cooling the latter.

It will be observed that the flange 1b is provided with a packing 22 capable of assuring an excellent seal between the top of the vessel and the dome, so that all the gases and fumes released are drawn into the extraction pipeline 11, only a few small losses occurring round the electrodes 5. Thus the pollution of the atmosphere of the steelworks is avoided to a great extent; moreover it is possible to recover the gases and fumes for suitable uses.

The internal face of the tubes 8 could be provided with barbs or studs 8c adapted to facilitate the hooking up of the slag thrown against the crown 4 during the production of the steel and which may thus constitute a gratuitous thermal insulation adapted to increase the long life of the dome and to reduce the thermal losses.

We claim:

1. A dome for an electric arc furnace of the type comprising a central portion (3) of refractory material and a cooled metallic crown (4) comprising two concentric toroidal pipes (6, 7) connected by radial tubes (8) to form an internal conduit for assuring the circulation of a cooling fluid in said crown, said dome comprising means for collecting gases originating from the production of steel and having a generally curved shape concave toward the base of said furnace, and said crown having a monolithic structure.

2. A dome for an electric furnace as claimed in claim 1, wherein said tubes (8) have a cross section which decreases toward the center.

3. A dome for an electric furnace as claimed in claim 1 or 2, wherein some of said radial tubes form a manifold (10) which fits with clearance in an extraction pipeline (11).

4. A dome for an electric furnace as claimed in claim 1 or 2, wherein said internal conduit of said crown (4) is connected to another similar conduit (13) situated above it by a double partition (14) and by a nest of tubes (15), for forming an annular chamber (16) for collecting gases, said chamber comprising a sleeve (21) which fits with clearance in an extraction pipeline (11) and passages (17) bringing it into communication with the interior of said furnace.

5. A dome for an electric furnace as claimed in claim 4, where the walls of said sleeve of said collecting chamber (16) are constructed by means of tubes (21) placed side by side and connecting two collectors (19, 20) in such a manner that cooling circulation of fluid can develop in said sleeve.

6. A dome for an electric furnace as claimed in claim 4, wherein the inner conduit of said crown (4) is provided with a support (12) for its refractory central portion (3).

7. A dome for an electric furnace as claimed in claim 1, wherein its own volume is at least equal to that of the molten steel produced in said furnace.

* * * * *